US009764542B2

(12) United States Patent
VanOstrand et al.

(10) Patent No.: US 9,764,542 B2
(45) Date of Patent: Sep. 19, 2017

(54) METHOD OF FLEXOGRAPHICALLY PRINTING A PLURALITY OF LINES

(71) Applicant: Eastman Kodak Company, Rochester, NY (US)

(72) Inventors: Daniel K. VanOstrand, Austin, TX (US); Kevin J. Derichs, Buda, TX (US)

(73) Assignee: EASTMAN KODAK Company, Rochester, NY (US)

( * ) Notice: Subject to any disclaimer, the term of this patent is extended or adjusted under 35 U.S.C. 154(b) by 0 days.

(21) Appl. No.: 15/181,476

(22) Filed: Jun. 14, 2016

(65) Prior Publication Data

US 2016/0288481 A1 Oct. 6, 2016

Related U.S. Application Data

(63) Continuation of application No. 14/404,892, filed on Dec. 1, 2014, now Pat. No. 9,446,578.

(51) Int. Cl.

| | |
|---|---|
| ***B41F 5/24*** | (2006.01) |
| ***B41F 3/54*** | (2006.01) |
| ***B41M 1/04*** | (2006.01) |

(52) U.S. Cl.

CPC ..... *B41F 3/54* (2013.01); *B41F 5/24* (2013.01); *B41M 1/04* (2013.01)

(58) Field of Classification Search

CPC ..... B41F 5/00; B41F 5/02; B41F 5/24; B41M 1/04

See application file for complete search history.

(56) References Cited

U.S. PATENT DOCUMENTS

| | | | |
|---|---|---|---|
| 4,101,324 | A | 7/1978 | Mizuno et al. |
| 4,610,950 | A | 9/1986 | Milliken |
| 6,314,879 | B1 | 11/2001 | Siler et al. |
| 6,343,550 | B1 | 2/2002 | Feesler |
| 6,701,847 | B2 | 3/2004 | Weichmann |
| 6,984,478 | B2 | 1/2006 | Dreher et al. |
| 7,126,724 | B2 | 10/2006 | McCrea et al. |
| 9,056,450 | B2 | 6/2015 | Kennair et al. |
| 2002/0152911 | A1 | 10/2002 | Weichmann |
| 2002/0170451 | A1 | 11/2002 | Nakazawa et al. |
| 2003/0113466 | A1 | 6/2003 | Frazzitta et al. |
| 2005/0157347 | A1 | 7/2005 | Dewitte |
| 2007/0181016 | A1 | 8/2007 | Schaede |
| 2007/0190452 | A1 | 8/2007 | Kimelblat et al. |

(Continued)

FOREIGN PATENT DOCUMENTS

| | | | |
|---|---|---|---|
| JP | 2009-059762 | A | 3/2009 |
| JP | 2011-115973 | A | 6/2011 |

(Continued)

*Primary Examiner* — David Banh

(74) *Attorney, Agent, or Firm* — Kevin E. Spaulding

(57) ABSTRACT

A method of flexographically printing a plurality of lines onto a substrate includes providing a flexo-master having a pattern of raised features including a plurality of lines. At least two of the lines intersect at a junction, wherein the junction includes one or more hollow voids. The flexo-master is used to apply ink onto the substrate forming a printed pattern including a printed junction corresponding to the junction on the flexo-master, wherein the printed junction has a different shape than the junction on the flexo-master.

8 Claims, 15 Drawing Sheets

(56) References Cited

U.S. PATENT DOCUMENTS

| | | | | |
|---|---|---|---|---|
| 2007/0272104 | A1* | 11/2007 | Burgio | B41F 23/08 101/335 |
| 2008/0199660 | A1 | 8/2008 | Gelli | |
| 2009/0191333 | A1 | 7/2009 | Pinto et al. | |
| 2010/0028815 | A1 | 2/2010 | Zwadlo | |
| 2010/0314058 | A1 | 12/2010 | Hupp et al. | |
| 2011/0180826 | A1 | 7/2011 | Morito et al. | |
| 2011/0259221 | A1 | 10/2011 | Hargreaves et al. | |
| 2012/0048135 | A1 | 3/2012 | Burberry et al. | |
| 2012/0196229 | A1 | 8/2012 | Sanger | |
| 2014/0053746 | A1 | 2/2014 | Ramakrishnan | |
| 2014/0245908 | A1 | 9/2014 | Ramakrishnan et al. | |
| 2014/0245912 | A1 | 9/2014 | Ramakrishnan et al. | |
| 2014/0290517 | A1 | 10/2014 | Miller | |
| 2015/0030984 | A1 | 1/2015 | Ramakrishnan | |

FOREIGN PATENT DOCUMENTS

| | | |
|---|---|---|
| WO | WO2006/092817 | 9/2006 |
| WO | WO2013/188379 | 12/2013 |

* cited by examiner

METHOD OF FLEXOGRAPHICALLY PRINTING A PLURALITY OF LINES

CROSS-REFERENCE TO RELATED APPLICATIONS

This application is a continuation of prior U.S. patent application Ser. No. 14/404,892, filed on Dec. 1, 2014 (published as U.S. Patent Application Publication 2015/0122138) and issued as U.S. Pat. No. 9,446,578 on Sep. 20, 2016, by D Van Ostrand et al., entitled "Methods of manufacture and use of customized flexomaster patterns for flexographic printing," which claims priority to U.S. Patent Application No. 61/657,942, filed on Jun. 11, 2012.

FIELD OF THE INVENTION

The invention relates generally to the field of methods for printing conducting patterns on flexible substrates, and in particular to a method for flexographically printing high-precision lines.

BACKGROUND OF THE INVENTION

Flexography is a form of rotary web letterpress, combining features of both letterpress and rotogravure printing, using relief plates comprised of flexible rubber or photopolymer plates and fast drying, low viscosity solvent, water-based or UV curable inks fed from an anilox roller. Traditionally, flexo-master patterns are created by bitmap pattern, where one pixel in bitmap image correlates to a dot of the flexo-master. For instance, pixels arranged in a straight line in the bitmap image will turn into a continuous straight line on the flexo-master. For traditional printing of graphic images, the width of lines or features printed may be important as long as the printed image looks good to the human eye. For flexographic printing or flexo-printing, a flexible plate with relief image is usually wrapped around a cylinder and its relief image is inked up and the ink is transferred to a suitable printable medium. In order to accommodate various types of printing media, flexographic plates may have a rubbery or elastomeric nature whose precise properties may be adjusted for each particular printable medium. In general, the flexographic printing plate may be prepared by exposing the UV sensitive polymer layer through a photomask, or other preparation techniques.

SUMMARY OF THE INVENTION

The present invention represents a method of flexographically printing a plurality of lines onto a substrate, comprising:

- providing a flexo-master having a pattern of raised features including a plurality of lines, wherein at least two of the lines intersect at a junction, and wherein the junction includes one or more hollow voids;
- using the flexo-master to apply ink onto the substrate forming a printed pattern including a printed junction corresponding to the junction on the flexo-master, wherein the printed junction has a different shape than the junction on the flexo-master.

In another aspect, the flexo-master is on a printing plate cylinder that rotates in a first direction, wherein a first portion of the plurality of lines on the flexo-master are oriented within a first predetermined range of the first direction, and wherein a second portion of the plurality of lines on the flexo-master are oriented at an angle outside of the first predetermined range of the first direction; and wherein the first portion of the plurality of lines are non-continuous lines, and wherein the second portion of the plurality of lines are continuous lines.

This invention provides a method of printing high-precision, continuous lines and patterns on a substrate using non-continuous patterns on the flexo-master.

This invention has the advantage that it reduces printing artifacts at intersections between printed lines.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
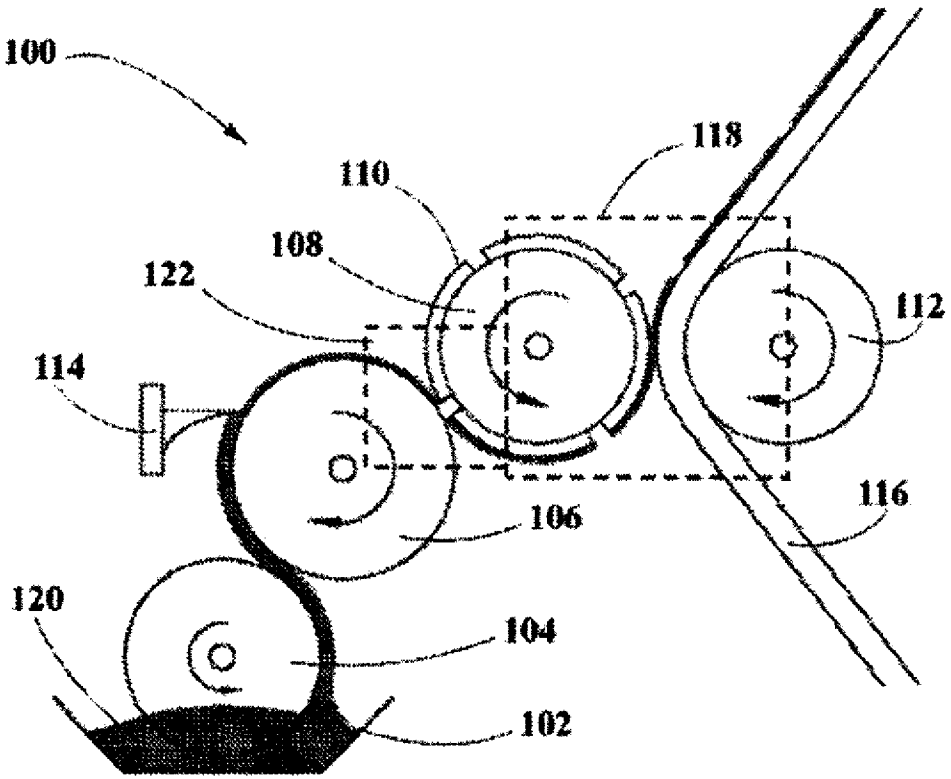
FIG. 1 illustrates an exemplary flexo-printing process that may be capable of implementing embodiments of the present disclosure.

The term "flexo-master," as used herein, may refer to the rubber or photopolymer piece or sheet comprising the patterns to be printed onto a substrate. Generally, the flexomaster is the "master-copy" or master-plate, having a relief or relieved shape. In alternative embodiments, the flexo-master may comprise a raised shape of a pattern for printing on a substrate.

The patterns are formed on the flexo-master by engraving a pattern modified to account for or in consideration of the physical characteristics of the flexo-master material and the effects that the different printing factors, such as target speed, viscosity, pressure, and volume of ink provided by the anilox roll, have on the final printed pattern. As used herein the term "anilox roll" refers to a cylinder used to provide a measured amount of ink to a printing plate. In an embodiment, to form a flexo-master, a pattern designed using any CAD software is converted into a tagged image format file (tiff file). Then it is loaded to a laser imaging system. In the laser imaging system the pattern is ablated into the black resist material covering a UV transparent substrate. Next, a blank elastomeric laminated photoresist (also known as a "flexo-plate" or a "flexo-blank") is exposed to a UV light through the laser ablated pattern. Where the UV light interacts with the flexo-plate, the pattern is "recorded" in the laminated photoresist. Once the UV exposure is complete, the flexo-plate is developed, dried and cut. This may then be referred to as a flexo-master (laminated elastomeric photoresist, carrying the pattern on one side) and may then be adhered to a printing plate cylinder. It is appreciated that the terms "flexo-plate" and "flexo-master" may be used interchangeably herein to mean a patterned flexo-blank capable of printing a pattern or a portion of a pattern. Please note that this is one method for making a flexo-master, but not the only method. Other methods include direct laser ablation of the pattern into a polymer substrate. Either of these patterning methods can be done on flat plates or on patternable material pre-coated on a cylinder sleeve. Patterned sleeves can be mounted to the printing plate cylinder by simply sliding them over the end of the cylinder. Embodiments of the invention are not dependent upon a specific method for making a flexo-master, but rather are focused on methods for overcoming the drawbacks inherent in the physical properties of the flexo-material, ink, substrate, and printing equipment. The ink as discussed herein may refer to the combination of monomers, oligomers, or polymers, metal elements, metal element complexes or organometallics in a liquid state that is discretely applied over a substrate surface.

For instance, wide solid lines may be formed by making a pattern on the flexo-master comprising multiple thin lines or features. In certain instances, a flexo-master configured thusly may avoid printing defects, such as non-uniform ink transfer within large features, for example greater than about 50 μm, and potential continuity problem at the boundary between large and small features or lines. Non-uniform ink transfer is the term used to describe when ink is deposited in an unintended manner, forming an unintended pattern or portion of a pattern as opposed to uniform ink transfer where ink is deposited in the shape of an intended pattern. As used herein, the term "uniform" is meant to distinguish intentional ink deposition on a substrate as opposed to unintentional ink deposition on the substrate. The term "repeatable" is used herein to refer to the ability of a flexo-master as well as the systems and methods employing the flexo-master (or flexo-masters) to print uniform patterns on a reliable, consistent basis. Another aspect of the present invention provides a technique to print lines or features in different angles, as well as accommodating the changes to line or feature patterns caused by the swelling of the flexo-master in time and with continued operation. Furthermore, within the context of the present invention, references to patterns of lines should be interpreted to include any pattern that can be made from a CAD drawing.

The disclosures of W0/2006/092817, entitled "Embossing Roller, Embossing Device Including Said Roller And Paper Article Produced With Said Embossing Device"; U.S. Patent Application Publication 20070181016, entitled, "Printing Machine"; U.S. Patent Application Publication 2002/0170451, entitled "Method Of Lithographic Printing"; U.S. Patent Application Publication 2007/0190452, entitled, "Flexographic Printing Plate Precursor And Imaging Method"; U.S. Patent Application Publication 2010/0028815, entitled "System And Method Employing Secondary Back Exposure Of Flexographic Plate"; and U.S. Patent Application Publication 2009/0191333 entitled, "Method For Providing Or Correcting A Flexographic Printing Plate, Sleeve, Or Precursor Thereof" may be relevant to the invention herein, and are hereby incorporated by reference.

Flexography is a form of rotary web letterpress printing where relief plates are mounted onto a printing cylinder, for example, with double-sided adhesive. However, traditional flexo-printers cannot consistently print fine lines with widths of less than 10 microns (μm) that are unbroken and of uniform width. The flexo-printing process has certain commercially favorable characteristics such as ease of use and cost. However, for printing high precision patterns commercially, the method and process may not consistently control printed feature width, thickness and pattern continuity due to convention weaknesses. In some examples, the flexo-substrate may be too flexible; therefore, fine line patterns are easily distorted making it difficult to maintain the shape and continuity of the fine printed lines and patterns. In addition, the flexo-substrate is absorbent to humidity and fluids and may swell. Swelling of the flexo-substrate may lead to differential distortion of different sized features, especially when these distortions are in close proximity. Additionally, different volumes of ink are printed depending on the pattern and proximity of various features. Thus, wide line patterns, having individual line or feature widths greater than about 50 microns, do not print a uniform layer of ink within the full width of the pattern. As such, there is a need in the industry to flexo-graphically print high-precision patterns.

These relief plates, which may also be referred to as a master plate or a flexo-plate, may be used in conjunction with fast drying, low viscosity solvents, and ink fed from anilox or other two roller inking systems. It is appreciated that a master plate may be any roll carrying a predefined pattern used to print on any substrate, and that the anilox roll may be a cylinder used to provide a measured amount of ink to a printing plate. The ink may be, for example, water-based or ultraviolet (UV)-curable inks. In one example, a first roller transfers ink from an ink pan or a metering system to a meter roller or anilox roll. The ink is metered to a uniform thickness when it is transferred from the anilox roller to a plate cylinder. When the substrate moves through the roll-to-roll handling system from the plate cylinder to the impression cylinder, the impression cylinder applies pressure to the plate cylinder which transfers the image onto the relief plate to the substrate. In some embodiments, there may be a fountain roller instead of the plate cylinder and a doctor blade may be used to improve the distribution of ink across the roller.

Flexographic plates may be made from, for example, plastic, rubber, or a photopolymer which may also be referred to as a UV-sensitive polymer. As used herein the term photopolymer refers to a polymer sensitive to light and that changes its properties when exposed to light, usually in the ultraviolet spectrum. The plates may be made by laser engraving, photomechanical, or photochemical methods. The plates may be purchased or made in accordance with any known method. The preferred flexographic process may be set up as a stack type where one or more stacks of printing stations are arranged vertically on each side of the press frame and each stack has its own plate cylinder which prints using one type of ink and the setup may allow for printing on one or both sides of a substrate. In another embodiment, a central impression cylinder may be used which uses a single impression cylinder mounted in the press frame. As the substrate enters the press, it is in contact with the impression cylinder and the appropriate pattern is printed. Alternatively, an inline flexographic printing process may be utilized in which the printing stations are arranged in a horizontal line and are driven by a common line shaft. In this example, the printing stations may be coupled to curing stations, cutters, folders, or other post-printing processing equipment. Other configurations of the flexographic process may be utilized as well.

In an embodiment, flexo-plate sleeves may be used, for example, in an in-the-round (ITR) imaging process. In an ITR process, the photopolymer plate material is processed on a sleeve that will be loaded onto the press, in contrast with the method discussed above where a flat plate may be mounted to a printing cylinder, which may also be referred to as a conventional plate cylinder. The flexo-sleeve may be a continuous sleeve of a photopolymer with a laser ablation mask coating disposed on a surface. In another example, individual pieces of photopolymer may be mounted on a base sleeve with tape and then imaged and processed in the same manner as the sleeve with the laser ablation mask discussed above. Flexo-sleeves may be used in several ways, for example, as carrier rolls for imaged, flat, plates mounted on the surface of the carrier rolls, or as sleeve surfaces that have been directly engraved (in-the-round) with an image. In the example where a sleeve acts solely as a carrier role, printing plates with engraved images may be mounted to the sleeves, which are then installed into the print stations on cylinders. These pre-mounted plates may reduce changeover time since the sleeves can be stored with the plates already mounted to the sleeves. Sleeves are made from various materials, including thermoplastic composites, thermoset composites, and nickel, and may or may not be reinforced with fiber to resist cracking and splitting. Long-run, reusable sleeves that incorporate a foam or cushion base are used for very high-quality printing. In some embodiments, disposable "thin" sleeves, without foam or cushioning, may be used.

The systems and methods disclosed herein leverage ink properties such as viscosity along with processing parameters and machine settings related to pressure, line speed, component selection (i.e. ink roll, anilox roll selection) and flexo-master design to produce microscopic uniform printed patterns. Phenomena that may be referred to as "dot gain" may cause printed material to be larger or different than intended, in some cases because the ink has a smeared appearance which may also indicate that the pattern intended during printing has not printed uniformly, completely, or a combination of both. Dot gain may be due to a combination of factors including contact pressure between the printing plate cylinder that has the flexo-master and the substrate, from the insufficient or excessive transfer of ink, machine temperature at transfer/contact areas, ink viscosity, and ink composition. As such, the present invention leverages this phenomenon in the design of flexo-masters which may be capable of printing high resolution patterns which, as discussed above, may comprise lines with widths larger than 50 microns, smaller than one micron (sub-micron-size), as well as sizes in between 1 micron and 50 microns. In some embodiments, these printed patterns may be further processed, which may be costly processing that lends itself to clearly and uniformly printed patterns. In other embodiments, the printed patterns may be used as-is or shelved for potential further processing so the pattern stability may also considered.

FIG. 1 illustrates an exemplary flexo-printing process that is capable of implementing embodiments of the present invention. The flexographic printing system 100 may comprise an ink pan 102 or other ink source, a fountain roll 104 or ink roll, an anilox roll 106 or meter roll, a printing plate cylinder 108, an impression cylinder 112 or NIP roll, and a doctor blade 114 to remove excess ink, which may be used in combination to print on a substrate 116. The ink roll 104 transfers ink 120 from the ink pan 102 to the anilox roll 106. The anilox roll 106 may be constructed of a steel or aluminum core which is coated by an industrial ceramic whose surface contains millions of very fine dimples, known as cells. The anilox roll 106 may be selected to transfer a specific volume of ink 120 depending upon the pattern configuration and ink type and viscosity as well as other machine setup parameters.

In an embodiment, the doctor blade 114 may remove the excess of ink on the anilox roll 106 which meters the ink to a uniform thickness onto printing plate cylinder 108. A flexo-master 110 may be disposed on the printing plate cylinder 108 which is used to print a pattern on the substrate 116. The flexo-master 110 may be disposed on/affixed to the printing plate cylinder 108 using adhesive on at least one of the flexo-master 110 and the printing plate cylinder 108, or by mechanical means, thermal means, chemical means, or combinations thereof. In some embodiments, more than one printing plate cylinder 108 may be used to print a single pattern on the substrate 116. In such embodiments, a plurality of flexo-masters 110 may be disposed, one on each printing plate cylinder 108, and more than one composition or viscosity of ink 120 may be used. In other embodiments, a plurality of flexo-masters 110 may be used to print more than one pattern on the substrate 116 which may be further processed into individual segments. It is appreciated that the printing may occur on one side of the substrate 116 or on both sides of the substrate 116 depending upon the end application of the printed pattern(s). The substrate 116 may move between the printing plate cylinder 108 and the impression cylinder 112. The impression cylinder 112 may apply pressure to the printing plate cylinder 108, thereby transferring an image in ink 120 from the flexo-master 110 onto the substrate 116. The rotational speed of the printing plate cylinder 108 may be synchronized to match the speed at which the substrate 116 is moving through the flexographic printing system 100, which may also be referred to as a roll-to-roll handling system. In some embodiments, the speed may vary between 20 feet/minute and 2,600 feet/minute. The flexo-master 110 may include any or all of a junction, a non-continuous line, or other flexo-master 110 features or methods of utilizing the combination of at least the flexo-master 110 features, ink viscosity, and machine pressure to deposit ink 120 in a flexo-graphic printing process in only the intended areas, which may also be referred to as uniform printing or uniform pattern printing, and to not deposit ink in unintended areas on the substrate 116. In an embodiment, the intended areas on the substrate 116 may be referred to as a plurality of locations associated with the flexo-master 110 pattern.

In an embodiment, the printing plate cylinder 108 may be made of metal, and the surface of the printing plate cylinder 108 may be plated with chromium, for example, for the purpose of increasing abrasion resistance. The substrate 116 may be a printable substance such as polyethylene terephthalate (PET), High-density polyethylene (HOPE), linear low-density polyethylene (LLDPE), biaxially-oriented polypropylene (BOPP), polyester, polypropylene, foam sheets, paper, aluminum foil, other metallic foil, or thin glass. It is appreciated that polyethylene terephthalate (PET), as used herein refers to a melt-phase PET resin, for example a reactor-grade polyester or polyester chip, that may be the polymer used in the production of polyester family and used in engineering resins often in combination with glass fiber. In certain instances, the PET or PET films are heat stabilized and may or may not have adhesion promotion coatings. A polymer substrate as discussed herein for the substrate 116 may be an acrylate which can be optically clear. In one example, the substrate 116 may have a maximum thickness of about 0.50 mm.

FIG. 1 also illustrates a contact printing area 118 which may include the printing plate cylinder 108, the impression cylinder 112, the flexo-master 110, the substrate 116, and the ink transfer area 122. The ink transfer area 122 may include the anilox roll 106, the flexo-master 110, and the printing plate cylinder 108. It is appreciated that, for embodiments where more than one printing plate cylinder 108 is used, there may be more than one ink transfer area 122 and/or contact printing area 118.

Figure 2:
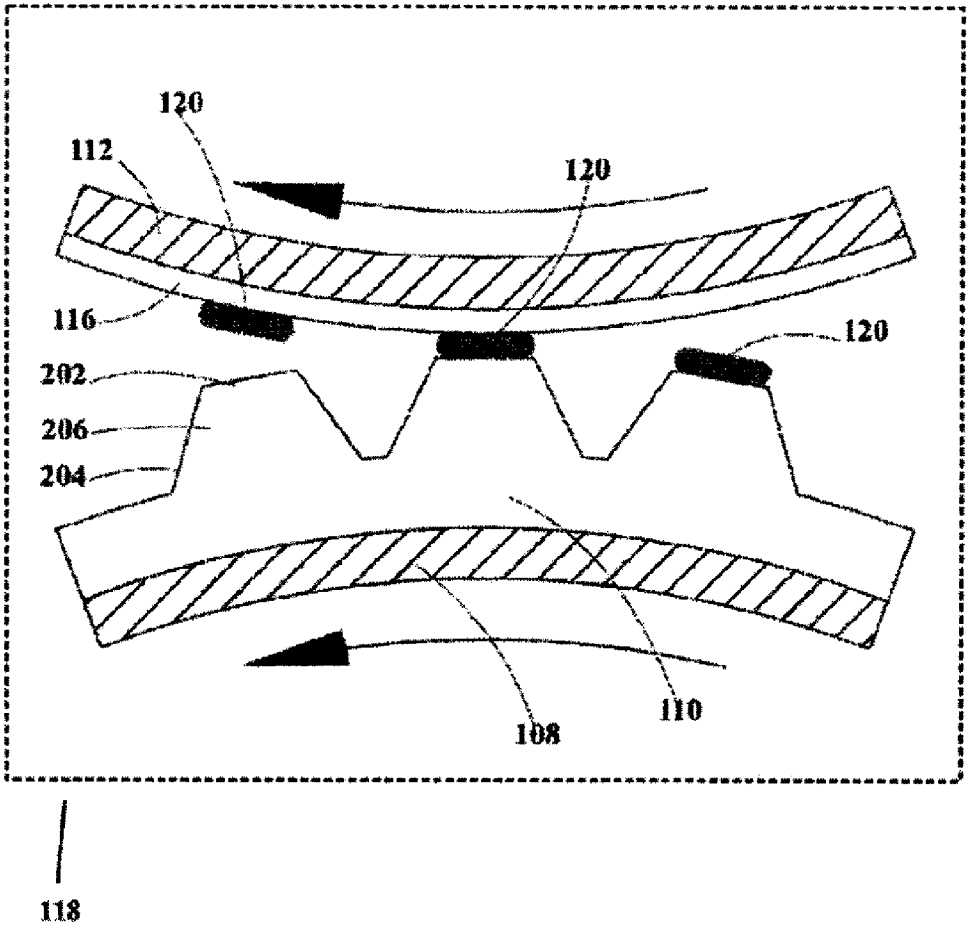
FIG. 2 is an illustration of an expanded view of a cross-section of a contact printing area.

FIG. 2 is an illustration of an expanded view of a cross-section of a contact printing area 118. The contact printing area 118, as discussed with respect to FIG. 1, is the area where the flexo-master 110 is in contact with the substrate 116. A raised printing surface 202 having lines 206 that represent a pattern to be printed may be engraved on flexo-master 110 and may exhibit angled sidewalls 204. In an alternate embodiment (not pictured) the lines 206 may be recessed. Ink 120 is transferred from an ink source to, for example, an anilox roll 106 (FIG. 1) to the raised printing surface 202 to the substrate 116 when an impression cylinder 112 presses the substrate 116 against the raised printing surface 202 while the printing plate cylinder 108 and the impression cylinder 112 are synchronously rotating. This contact printing area 118 is illustrated as an example of a preferable embodiment wherein the ink 120 is picked up by the raised pattern line 206 and transferred in a clean, precise, uniform, and repeatable fashion to the substrate 116, and may be contrasted with, for example, FIG. 4(*a*) and FIG. 4(*c*).

Figure 3:
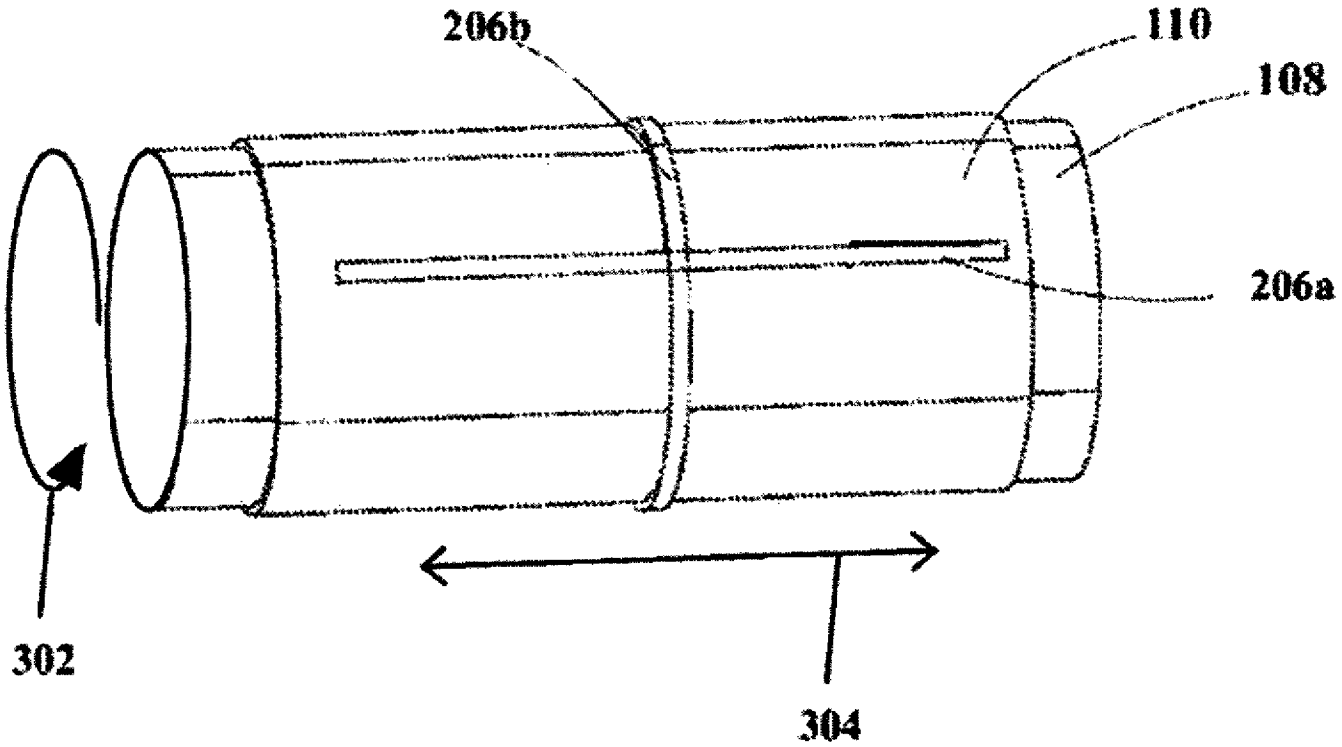
FIG. 3 illustrates a transverse direction (T) and a machine direction (M) for a roll to roll flexographic printing system according to embodiments of the present disclosure.

Flexo-Master Pattern Orientations:

FIG. 3 illustrates a transverse direction 304 and a machine direction 302 for a roll-to-roll flexographic printing system 100 (FIG. 1) according to embodiments of the present invention. In some embodiments, the present disclosure relates to flexo-master patterns oriented with respect to the rotational direction of the printing plate cylinder 108. FIG. 3 shows a line 206*a* oriented in the transverse direction 304 and a line 206*b* oriented in the machine direction 302 on the flexo-master 110. It is understood that the lines 206*a* and 206*b* are representative of a plurality of lines forming a pattern or patterns that may ultimately be used as conductive patterns for applications including, but not limited to, touch screen and RF antenna applications, and that discussion of a line in a particular direction is representative of a pattern in the same direction. In a flexo-master 110 with the transverse direction 304 oriented line 206*a*, all of the ink 120 may be transferred as the result of the discrete impact of the raised printing surface 202 when it comes in contact with the substrate 116. In a flexo-master 110 with the machine direction 302 oriented line 206*b*, the printing surface 202 may be preferably continuously in contact with substrate 116 and the ink 120 may be transferred onto the substrate 116 for the length of the lines 206*b* as the printing plate cylinder 108 rotates. It is appreciated that the ink 120 is comprised of one or more droplets of liquid that adhere to the raised printing surface 202 of the lines 206*a* or 206*b* on the flexo-master 110.

Figure 4:
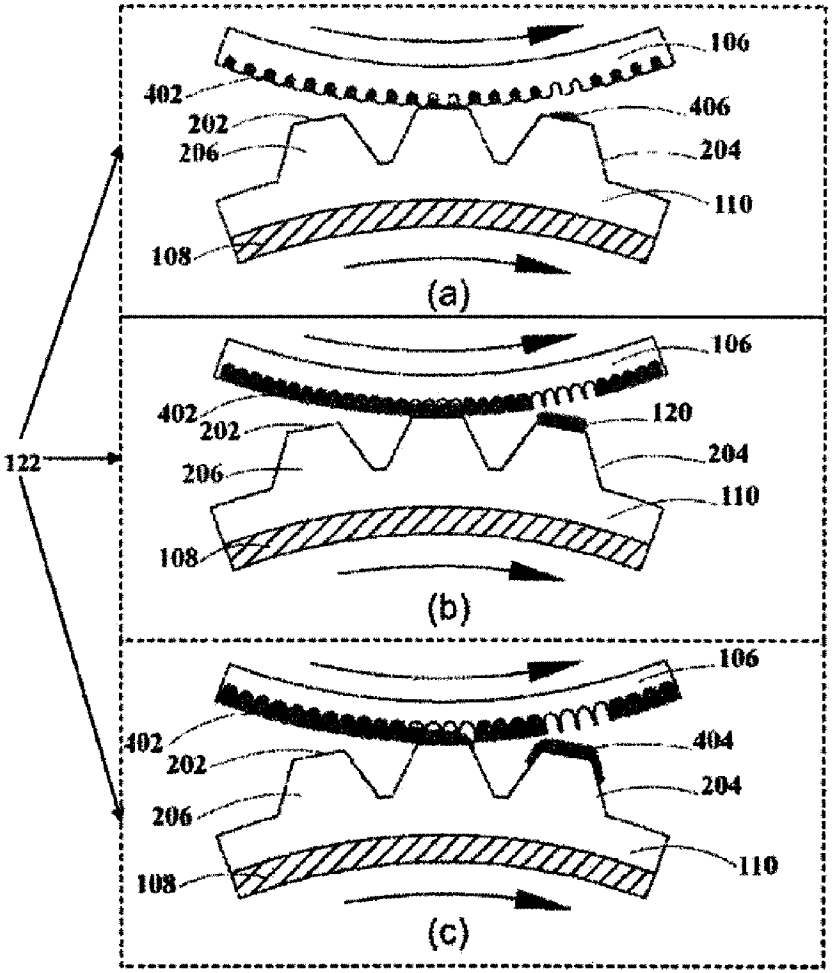
FIG. 4 illustrates exploded cross-sectional views of ink transferring areas.

Ink Transfer Volume:

FIG. 4 illustrates exploded cross-sectional views of ink transferring areas. FIG. 4 shows ink transfer by the anilox roll 106 to the flexo-master 110 within ink transferring areas 122 as shown in FIG. 1. In an embodiment, the anilox roll 106 may have some control over the amount of ink 120 that is transferred based on the cell size of anilox roll 106, that is, different sizes of cells 402 transfer different volumes of ink 120 to flexo-master 110. In FIG. 4(*a*), when insufficient ink 406 is transferred from the anilox roll 106 to the lines 206 on the flexo-master 110, there may not be enough ink 120 transferred to either the lines 206 and/or the raised printing surface 202 to form a uniform, dimensionally intact pattern. As used herein, a dimensionally intact or dimensionally correct pattern refers to the uniform pattern printed discussed above where ink is only deposited in intended locations and is not deposited in unintended locations. This pattern may be made to a predetermined set of customer specifications, internal specification, regulatory requirements, or combinations thereof. This may also be referred to as a uniformly printed pattern or uniform pattern.

The transfer of an insufficient amount of ink as illustrated in FIG. 4(*a*) may result in insufficient pattern printing, which may result in scrap and/or the inability to further process the printed pattern and/or a defunct intermediate or final product that includes the printed pattern. By controlling and varying printing factors as discussed herein, a desired width for printed lines or features may be achieved using the flexo-master 110 designs described herein. The printing factors that may be varied include print speed, pressure, ink viscosity and volume of ink transferred (anilox roll). As discussed herein, some properties of ink such as the viscosity and volume may be leveraged by the design and design direction of the flexo-master 110 to take advantage of properties such as bleeding to form complete, uniform patterns.

Conversely, as shown in FIG. 4(*c*), if the amount of ink 120 transferred onto the lines 206 on flexo-master 110 is too large to be contained solely on the printing surface 202, the excess ink 404 may spread out and adhere to a portion of the sidewall 204 immediately adjacent to raised printing surface 202 of lines 206. It is appreciated that this may be a concern because if the ink 120 is unintentionally forced onto the sidewall 204, that may mean that the pattern is not printed uniformly on the substrate 106. In addition, if one or more lines 206 from the pattern on the flexo-master 110 has excess ink 404 in at least the sidewall 204 location, this can cause a problem as the printing process continues, resulting in clumping and/or the flexo-master not being able to hold the correct amount of ink 120. In an embodiment discussed below in FIG. 9, the use of excess pressure may be leveraged to produce two separate printed lines from one flexo-master line 206. And finally, FIG. 4(*b*) depicts what may be a preferred embodiment of ink transfer from the anilox roll 106 to the flexo-master 110, as demonstrated by the ink 120 being transferred on to the substrate 106 completely and uniformly.

Figure 5:
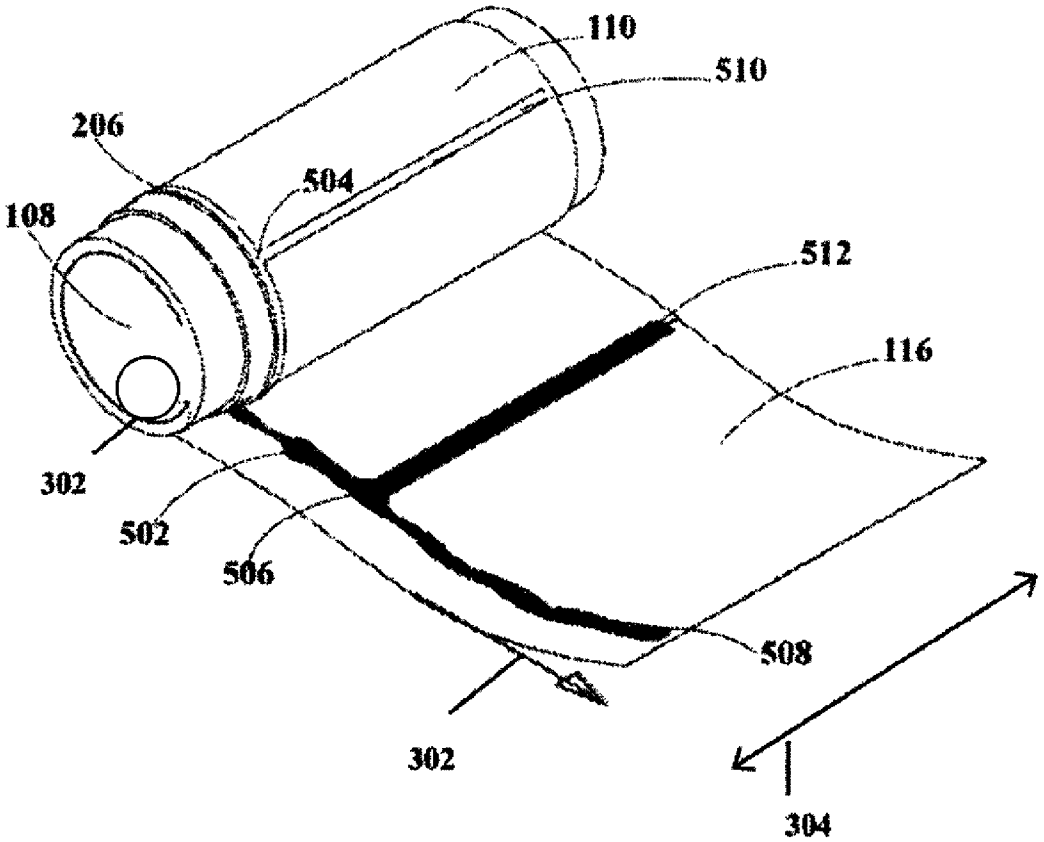
FIG. 5 is an illustration of a substrate flexo-graphically printed with excess ink.

FIG. 5 is an illustration of a substrate flexo-graphically printed with excess ink. FIG. 5 illustrates results such as those that may be caused by the excess ink 404 described in FIG. 4(*c*). Just as insufficient ink is the term used herein to describe when a pattern is not printed uniformly (when a pattern is printed with ink in unintended areas/locations or when ink is missing in intended locations, i.e., when there are gaps or other locations of missing ink) and/or correctly at least in part due to the amount of ink transferred, excess ink is the term used herein to describe the reverse problem, that is, when a pattern is not uniformly printed because more ink is transferred than is needed to print the desired pattern dimensions and geometry. The representative line 206 in the machine direction 302 and the line 510 in the transverse direction 304 may form a cross pattern 504 on the flexo-master 110. When printing lines 206 in the machine direction 302, at the point of contact between flexo-master 110 and substrate 116, the ink 120 that is still on flexo-master 110 may come in contact with both the substrate 116 and, potentially, a portion of the ink 120 that has already been transferred to the substrate 116. If there is excess ink 404 at this point of contact, then the ink 120 may be pushed forward as the line 206 in the machine direction 302 continues to rotate in contact with substrate 116.

This excess ink 404 may spread out as extra width of the printed line, continually making the edge of the printed line to appear to have an irregular shape 502 (e.g., a sinusoidal-type shape that may look like beads on a necklace), or it may accumulate in the cross pattern 504 or at similar junctions as discussed below. At this point, the entire volume of the excess ink 404 may be deposited at once, producing excess ink at crossover points 506. Alternatively, or in addition to this issue, the length of the printed line 206 may be extended, producing an ink appendage 508 after the line 206 in the machine direction 302 ends. In addition, the excess ink 404 may result in printed line 512 that may not have the shape issues of irregular shape 502 but may be significantly wider (i.e. out of spec for a desired application) than the line 510 was designed to print. In some cases, the printed line 512 may be wider than the line 510 on flexo-master 110 by possibly as much as 10 times the line width of line 510, and therefore may not be desirable as the flexo-master 110 is designed to produce lines with certain dimensional specifications that may not have a ±10× or ±5× width tolerance. It is appreciated that, in addition to issues with width, the length as well as height of the printed patterns may be adversely affected by the issues discussed above.

Figure 6:
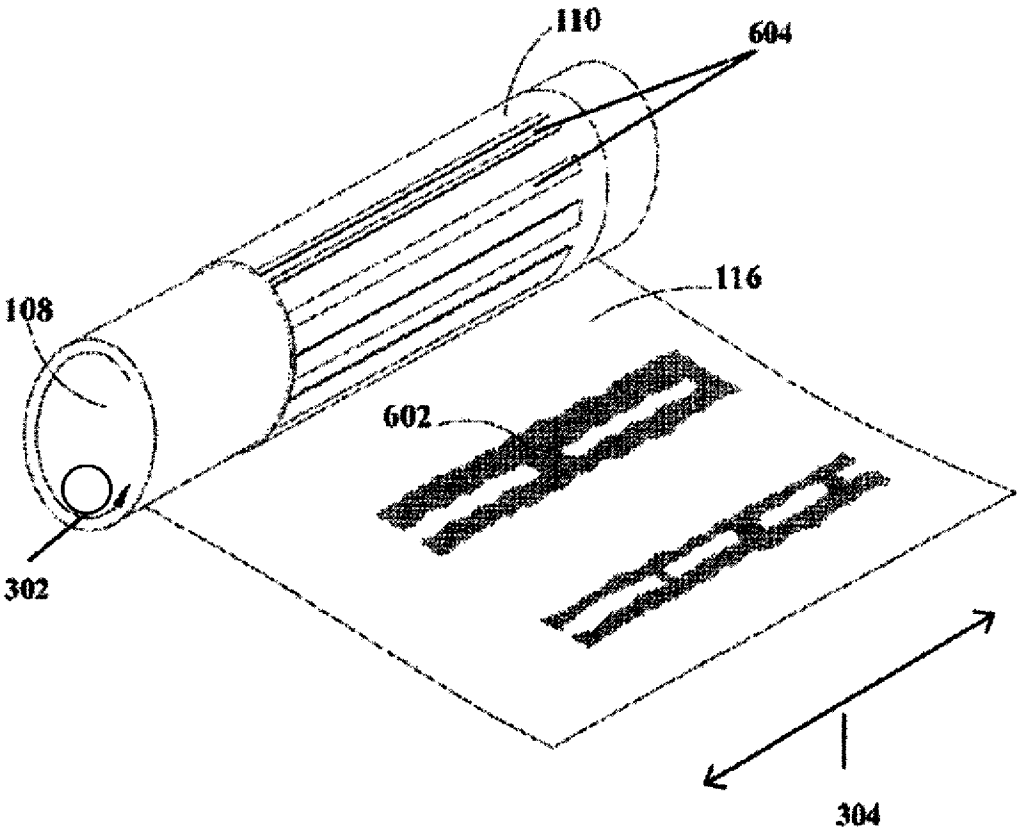
FIG. 6 is an alternate illustration of a substrate flexo-graphically printed with excess ink.

FIG. 6 is an illustration of a substrate flexo-graphically printed with excess ink. As used herein, the term "excess ink" is used to describe a condition when more ink that is needed to print a pattern is transferred from the ink source to the anilox roll 106 and/or from the anilox roll 106 to the printing plate cylinder 108 and/or from the printing plate cylinder 108 to the substrate 116. The excess ink 404 on one or more flexo-master lines 604 could merge when printed to form a bridge-like feature which may completely obfuscate the original intended pattern of lines 604. That is, two printed lines 602 printed by two separate lines 604 on the flexo-master 110 may be misshaped and/or merge together in part as shown for printed lines 602, this may not produce the desired uniform printed pattern and may cause the product to be scrapped. In some embodiments, scrap has cost, labor, and environmental implications which further impresses the desire to be able to print uniform patterns, where ink is only deposited in intended areas and is not deposited in unintended areas, on a repeatable basis with high resolution lines. As flexo-masters are designed to print patterns of lines with a certain width, length, height, and joinder feature size for each line or set of lines, it is understood that it is desirable to have none of the uncontrolled effects depicted in FIGS. 5 and 6. Instead, for example, using systems and method disclosed herein print clear, uniform patterns on a consistent, repeatable basis for cost effective manufacturing and end product reliability as well as intermediate post-printing processing. It is appreciated that, in some embodiments, printed patterns may be further cleaned, plated, cured, or otherwise treated, as discussed further in FIG. 14, so a poorly printed pattern may have even more of an impact on downstream processing.

Figure 7:
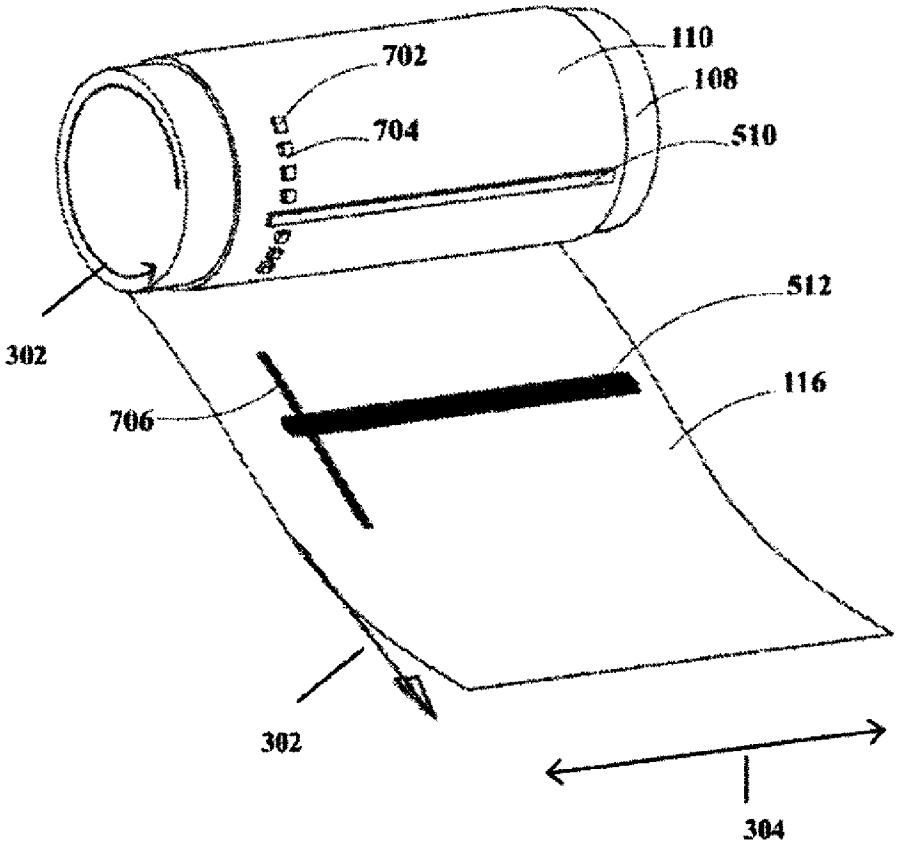
FIG. 7 is an illustration of a substrate printed according to embodiments of the present disclosure.

Therefore, to aid in reducing the effect in at least FIG. 6, instead of using continuous lines 604 at angles that are near parallel to the machine direction 302, it may be better to use non-continuous lines 702 (dotted or dashed lines, or gaps in the lines) as shown in FIG. 7 and discussed in detail below. It may also, in some embodiments, be desirable to leverage the effects shown in FIG. 6 to produce lines in a controlled fashion using the combination of printing parameters, ink properties, and flexo-master design as discussed above to use two or more lines 206 or features on a flexo-master 110 to form a single line or feature on the substrate 116. In such embodiments, the two or more lines used may be of the same dimensions, similar dimensions, differing dimensions, or a combination thereof with respect to the height, width, length, and shape of the two or more lines 206 on the flexo-master 110.

FIG. 7 is an illustration of a substrate 116 printed according to embodiments of the present invention. The example printed line 706 results from a non-continuous line 702 on the flexo-master 110. The non-continuous (or discontinuous) line 702 as discussed herein may be comprised of a plurality of uniform or non-uniform sections along a single direction or (not pictured) along more than one direction. A uniform section is one with approximately the same length, width, and height dimensions of other dimensions, and a non-uniform section may have differing dimensions, a non-continuous line 702 may comprise some sections that are uniform with respect to each other but that may differ with respect to other sections. In an embodiment, a non-continuous line 702 comprises only uniform sections, and in an alternate embodiment the non-continuous line 702 comprises only non-uniform sections, and in another embodiment the non-continuous line 702 may comprise a combination of sections some of which have at least one of the same or similar height, width, and length. The line sections, which may also be referred to as segments, of non-continuous line 702 may be, from a top view perspective, rectangular, square, circular, polygon, or combinations thereof as appropriate for printing the desired line or lines. Splitting what would be a continuous line on a flexo-master 110 into multiple sections as shown in the non-continuous line 702 may relieve the sinusoidal printing issue that may result from the excess ink 404 as described in FIGS. 5 and 6. By putting a gap spacing 704 between sections of the non-continuous patterned line 702 on the flexo-master 110, continuous features or printed lines 706 can be printed when the ink 120 merges together on the substrate 116.

In contrast to the accidental merging shown in FIG. 6, the merging in FIG. 7 can be controlled by the design of the flexo-master, as well as by the ink and machine setting factors/properties discussed above to form portions of a pattern. The gap spacing 704 required for a non-continuous line 702 or other feature comprised of more than one line 206 or by a transition between a line or lines 206 may vary in accordance to printing factors such as printing speed, viscosity of ink 120, pressure between flexo-master 110 and substrate 116, volume of ink 120 that anilox roll 106 transfers to flexo-master 110, and surface energy of substrate 116. Determining the proper gap spacing 704 can be accomplished by selecting a specific combination of the above printing factors such as ink viscosity, end pattern dimensions, pressure, etc., and printing lines oriented in the transverse direction 304. The actual width of the printed line 512 when compared to the width of the pattern line 510 will define the maximum gap spacing 704. The gap spacing 704 may be used to define the requirements and the adjustments to the original pattern design to make the lines 206 on the flexo-master 110. In another embodiment, a high precision flexo-master for making printed electronic patterns comprises printed lines 706 printed in machine direction 302 where the non-continuous lines 702 are non-continuous patterns. In this embodiment, if a 10 μm wide line on the flexo-master prints a 40 μm wide line on the substrate 116, which is 30 μm wider than the original patterned line, then the gap spacing in the pattern on the flexo-master may be made with less than a 30 μm gap between every line segment in order to obtain a continuous printed line. During the printing process, the excess ink merges together on the substrate, closing the gaps and providing a continuous printed line 706.

Figure 8:
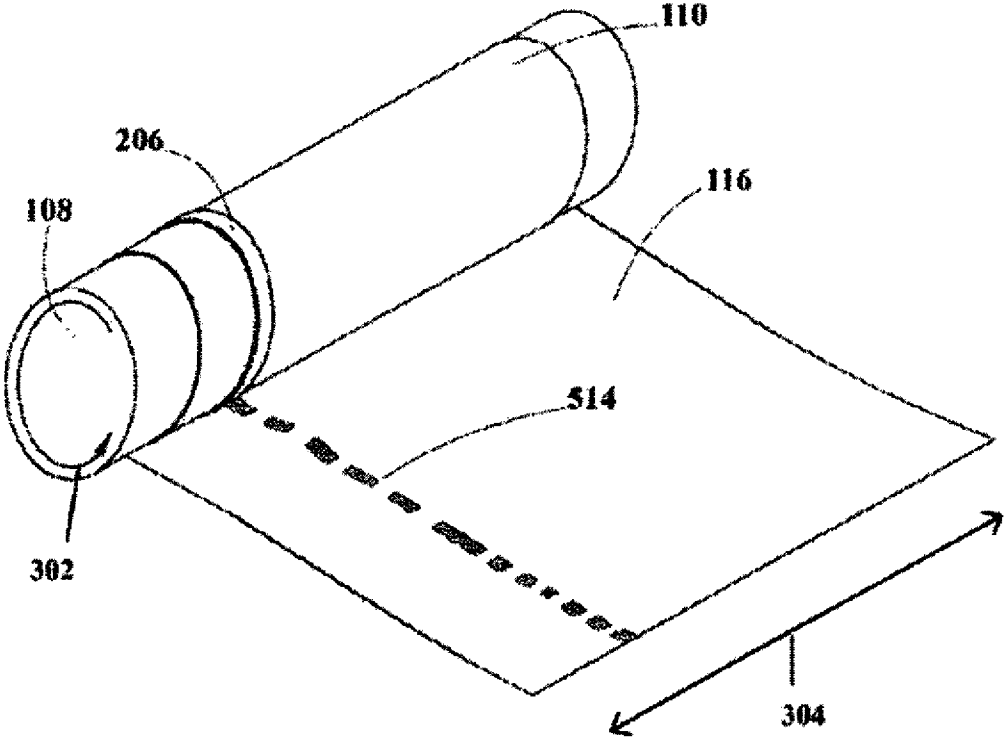
FIG. 8 is an illustration of a substrate flexo-graphically printed with insufficient ink.

FIG. 8 is an illustration of a substrate 116 flexo-graphically printed with insufficient ink 406. FIG. 8 is shown to illustrate what type of printed line may result from insufficient ink 406 transfer during any part of the transfer process. As discussed above relative to FIG. 4(*a*), the insufficient ink 406 may result from a number of factors including flexo-master design. For example, the flexo-master 110 may not have a uniform height on the pattern surface, i.e., if the lines or features of the pattern are of varying heights such that all of the pattern lines are not sufficiently covered in ink prior to printing. If the insufficient ink 406 on the printing surface 202 of the lines 206 is transferred to the substrate 116, then non-continuous printed lines 514 may be formed. Moreover, the amount of pressure applied towards pushing the flexo-master 110 into contact with substrate 116 may affect the amount of ink 120 transferred from the lines 206 on the flexo-master 110 and may also therefore have an effect on the resulting printed pattern of ink 120 transferred to the substrate 116. In some embodiments, a combination of insufficient ink volume and light pressure may result in a printed line width most closely matching the pattern on flexo-master 110. However, there may be irregularities in the top surface of flexo-master 110 which may result in gaps or breaks in the printed pattern.

Figure 9:
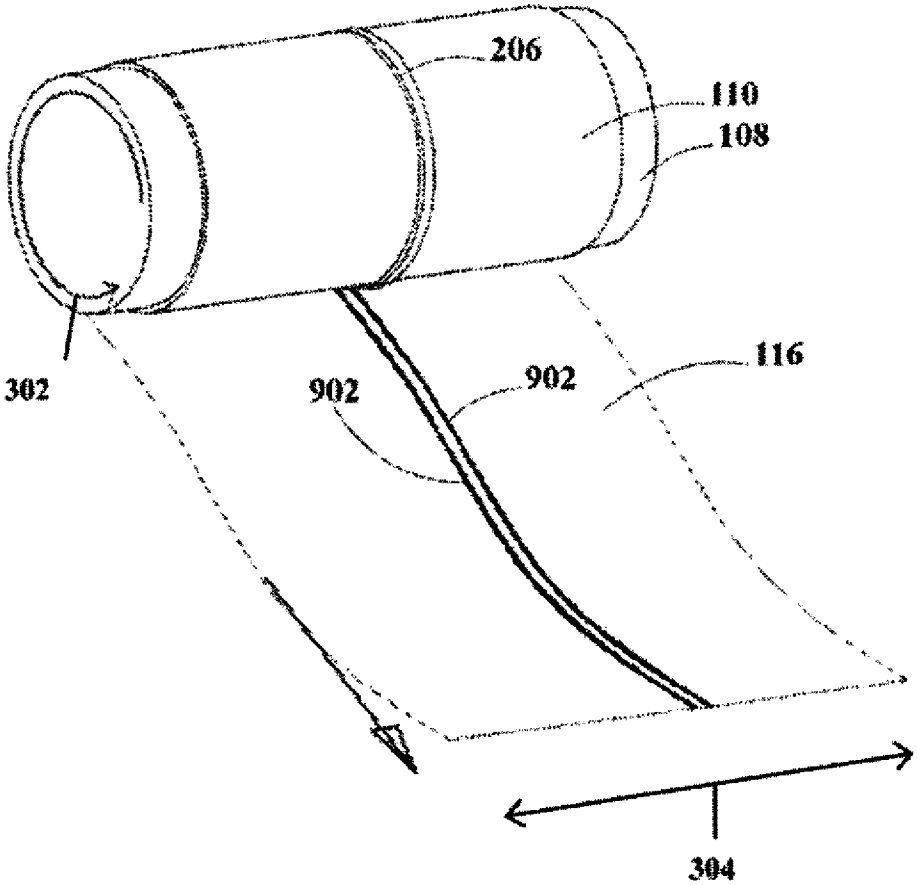
FIG. 9 is an illustration of the effect that excess pressure between the flexo-master and the substrate may have on printing.

Pressure Variations:

FIG. 9 is an illustration of the effect that excess pressure between the flexo-master 110 and the substrate 116 can have on printing. In this example, the use of the ink 120 with increased pressure, for example, between the substrate 116 and the flexo-master 110 that may be caused by an imprinting roll, results in a pattern of printed lines 902 having a total combined width is significantly wider than the original lines 206 on the flexo-master 110. As discussed above, the flexo-master 110 may be designed to print patterns with lines of specific dimensional tolerances so the wider lines may not be desirable. In FIG. 9, the pattern to be printed is a continuous line 206 oriented in the machine direction 302. However, when the flexo-master 110 is pushed into contact with substrate 116 with excessive pressure, all of the ink 120 is forced to the angled sidewalls 204 of the lines 206. The printed pattern from this printing operation is essentially two distinct printed lines 902 that are separated by a spacing that corresponds approximately to the width of the printing surface 202 of the lines 206 on flexo-master 110. To achieve the desired lines 206 or feature widths, in the printed pattern, a precise combination of ink volume and pressure may be used. In some embodiments, the designs of the flexo-master 110 as discussed herein may print patterns with line widths over 50 microns or larger, and in other embodiments the flexo-master designs may print patterns comprising line widths smaller than one micron (sub-micron sized lines), and in an alternate embodiment the line widths may be in between 1 micron and 50 microns.

Figure 10:
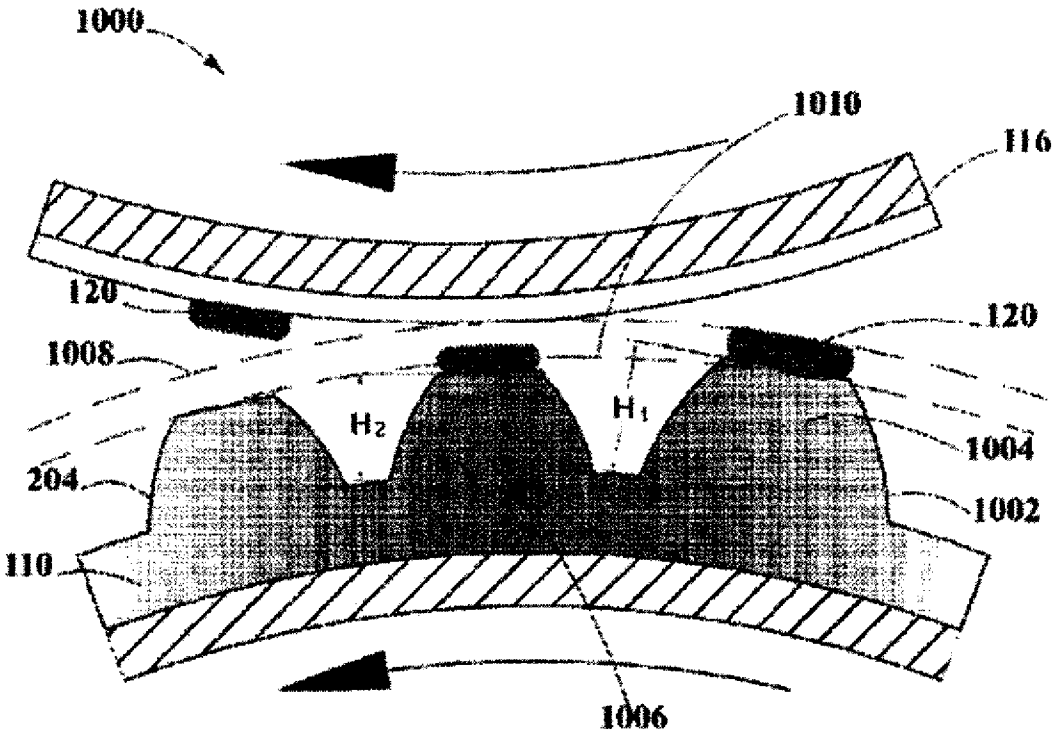
FIG. 10 is an illustration of the effect of flexo-master swelling in a flexographic printing system.

Swelling:

FIG. 10 is an illustration of the effect of flexo-master swelling in a flexographic printing system. FIG. 10 shows how the swelling of flexo-master 110 affects feature height and printing performance in a flexographic printing system 1000. FIG. 10 illustrates the example of volumetric swelling 1002 of a tall patterned line 1004 on the flexo-master 110, more specifically shown as bulging when compared to angled sidewall 204. The flexo-master 110 may be very flexible and may absorb moisture from high humidity and contact fluids such as the ink 120, adhesives, and other machine fluids. As a result of this absorption, the flexo-master 110 volumetrically swells, producing a distortion of the printed features, including changes to length, width, height, and shape of printed features, as well as height differential of various features depending on the volumetric cross section. Generally, tall patterned lines 1004 exhibit a height ($H_1$) higher than the height ($H_2$) of short patterned lines 1006. The ink 120 on tall patterned lines 1004 rotates across tall feature arc 1008, while ink 120 on the short patterned lines 1006 rotates across short feature arc 1010. In this scenario, due to the height differential between the tall feature arc 1008 and the short feature arc 1010, most, if not all of the ink 120 from the short patterned lines 1006 may not be properly transferred to the substrate 116 during the printing process and the desired uniform pattern may not be printed on the substrate 116. The height differential of various features in the flexo-master 110 may be caused by the fact that if there is a mass differential under a given point/portion of lines 206. In this case, lines 206 may swell from the absorption of moisture and the tall patterned lines 1004 may swell more than the short patterned lines 1006 because there is more volume of material under the higher density tall patterned lines 1004. In the methods disclosed herein, swelling may be accounted for by both the design of the flexo-master 110, as well as ink 120 selection, machine parameter selection, and machine component selection, for example with respect to anilox rolls 106.

Figure 11:
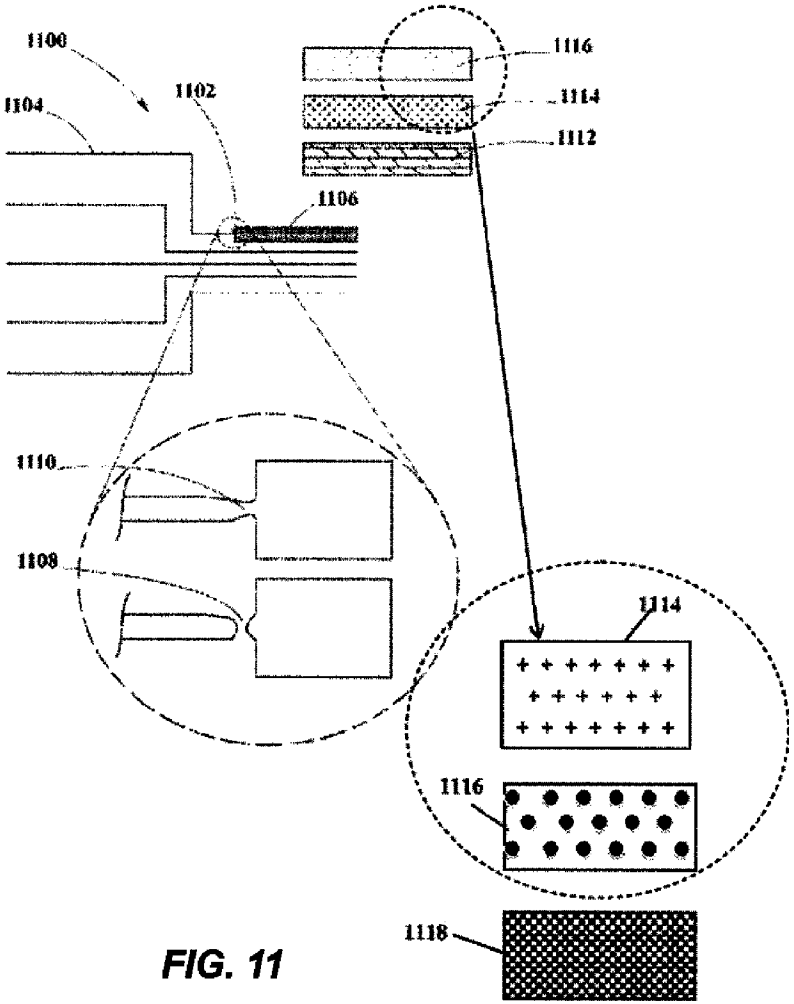
FIG. 11 illustrates exemplary results from a flexo-master pattern design with a junction between small and large features according to embodiments of the present disclosure.

FIG. 11 is an illustration of embodiments of a patterned line design with line fill patterns. A line fill pattern is the term used to describe when a pattern line or lines on a flexo-master 110 are texturized with one or more textures as discussed below and shown for effect in exploded views to assist pattern printing uniformity and promote ink deposition in intended locations and not in unintended locations. When a pattern is printed by a pattern design 1100 on, for example, a flexo-master 110 as discussed above, there may be different line widths that may need to be connected to each other at an intersection (junction), 90 degrees or otherwise, or in a corner, or in another transitional area and/or with a transitional geometry. In an embodiment, it may be desirable to have these connected/transitional areas formed on the flexo-master 110 without a potential height differential between the lines that may cause problems in the pattern continuity as discussed above in FIG. 10. A height differential may cause a printing issue, for example, when a set of printed lines produced by a plurality of tall patterned lines 1004 must connect to a set of printed lines produced by a plurality of short patterned lines 1006. Tall patterned lines 1004 may swell more as compared to short patterned lines 1006, becoming higher than the short patterned lines 1006. When this happens, there may be a gap in the printed pattern at the point the short patterned lines 1006 connect to taller features (or wider) lines due to height differential between the two sets of lines or features. In certain instances, wider lines or features may be replaced with multiple smaller lines or features near the same width as the smaller lines or features that need to be connected so that various printing issues can be minimized. If no adjustment in the printing pattern is made, a transitional area 1102 connecting small patterned lines 1104 and large patterned lines 1106 may have either a complete break 1108 in the printed pattern or a reduction (or necking 1110) in the printed width of the smaller line or feature at the junction/intersection/transition of features.

In an embodiment, when printing the large patterned lines 1106, for example, lines greater than 50 μm wide, there may be an issue with the uniformity of the printed pattern. The ink 120 may tend to attempt to form spheres (or bead up) due to surface tension of the ink 120 depending on the surface energy of the flexo-material. This can lead to a non-uniform distribution (both thickness and area) of ink 120 over the surface of large patterned lines 1106 on the flexo-master 110 before and after it is printed to substrate 116. This can create a non-uniform distribution of ink, in both thickness and area, of the printed ink 120 on the substrate 116.

Such non-uniformity of the ink 120 can cause problems with the conductivity or resistivity of a printed conductive pattern, and/or may impact further processing of that printed pattern. Fill patterns 1112, 1114, 1116 illustrate patterns that can be used for a patterned line. To clarify the fill patterns 1114, 1116, FIG. 11 contains an exploded view of those patterns as well as a checkered fill pattern 1118. In contrast to a flexo-master pattern that comprises a plurality of lines as discussed above, a fill pattern is the term used to describe the pattern that may be on some of all of the lines of the pattern on the flexo-master 110 designed to print lines of varying widths on the substrate. That is, one, some, or all of the lines on the flexo-master may be patterned lines using fill patterns 1112, 1114, 1116 in various combinations so that the printed ink pattern is sufficiently (dimensionally) and uniformly (consistency among and between patterns) filled. The exemplary fill patterns 1112, 1114, and 1116 are illustrative and other fill patterns and combinations of fill patterns can be used depending upon the application.

In an embodiment, non-uniform printing may be addressed by either printing multiple thin lines forming a brick fill pattern 1112 including a grid of thin lines with multiple interconnects to achieve the equivalent of a single large patterned line 1106, or to alter the pattern of the surface of the large patterned lines 1106 pattern on the flexo-master 110 in order to more uniformly transfer ink 120 to the substrate 116. The exploded views of fill patterns 1114, 1116 are provided for illustration, it is appreciated that the features of the fill patterns 1112, 1114, 1116, 1118 may be oriented as shown, or at 45°, 90°, 180°, or otherwise as appropriate for the flexo-master design. In another embodiment, a single conductive large pattern line 1106 of up to 500 μm wide can be printed by using a brick fill pattern 1112 of 20 μm width with gaps of about 20 μm (the actual gap value would be determined as previously described). Likewise, various fill patterns for large patterned lines 1106 can be used such as the cross fill pattern 1114 or dotted fill pattern 1116 instead of the brick fill pattern 1112 that includes thin lines. The actual size, shape and spacing values for these fill patterns will be determined from the values obtained from conducting print tests using a selected set of printing factors. In an embodiment, multiple flexo-masters 110 may be disposed on multiple printing plate cylinders 108 as shown in FIG. 1, and each flexo-master 110 may be used to print a portion of a single pattern. In that embodiment, the same ink 120 may be used for each portion of the pattern, or more than one ink 120 of varying composition or viscosity may be used to print the pattern. It is appreciated that, while 50 μm-wide or larger lines are discussed above, the fill patterns may be used on lines smaller than 50 μm, in which case, for example, the brick fill pattern 1112 may have dimensions of less than 20 μm.

Figure 12:
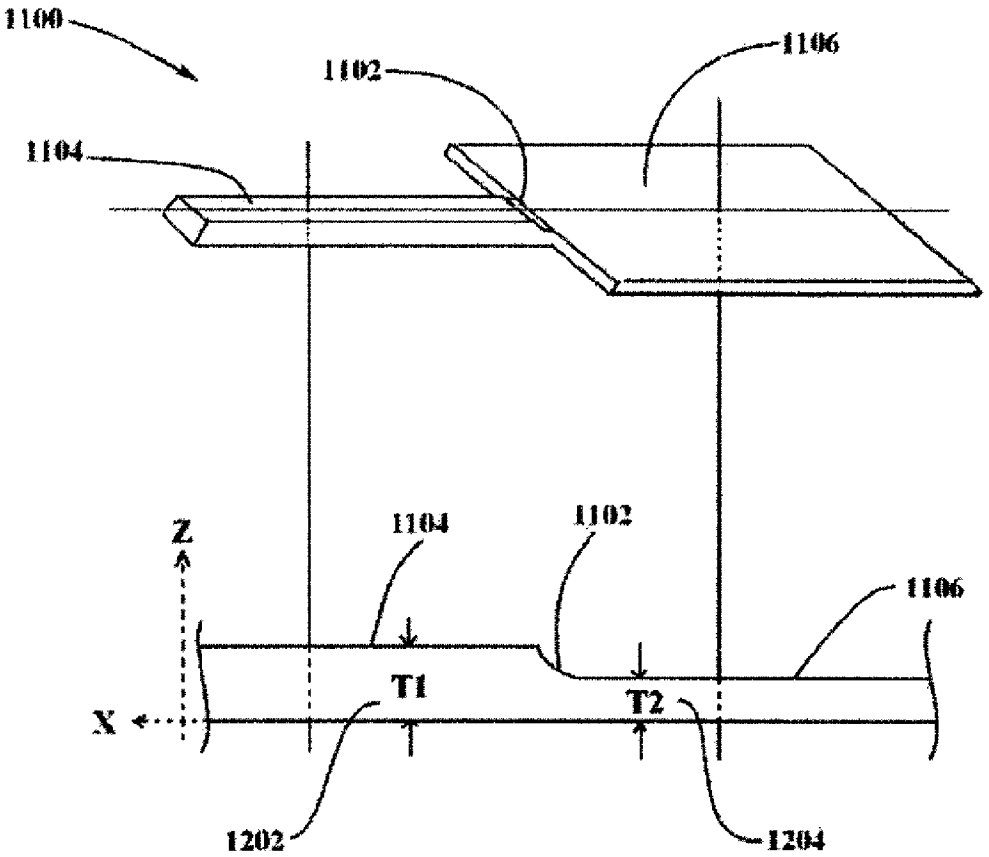
FIG. 12 illustrates a cross-sectional view and an isometric view of a flexo-master pattern design with a transitional area.

FIG. 12 illustrates a cross-sectional view and an isometric view of a flexo-master pattern design 1100 with a transitional area 1102. FIG. 12 shows an isometric depiction of the flexo-master pattern design 1100 on the flexo-master 110 (not shown). The cross sections of the features on the flexo-master 110 are also shown. Section T1 comprises a plurality of lines 1202 and section T2 comprises a plurality of lines 1204. In an embodiment, the plurality of lines 1202 in section T1 may be smaller in, for example, width and/or height, than the plurality of lines 1202 in section T2. Sections T1 and T2 illustrate the height differential caused when the photo-polymer under the features cross links and shrinks during the UV exposure (patterning) step discussed above with respect to flexo-master manufacture. In an embodiment, the larger the volume of photo-polymer, (e.g., in lines 1204 in section T2), the greater the shrinkage due to the cross linking of the polymer. Therefore, a large patterned line 1106 has a shorter cross-section than the small patterned line 1104. Stated differently, wider lines on a flexo-master 110 may have shorter heights as compared with thinner lines on the same flexo-master 110.

Figure 13:
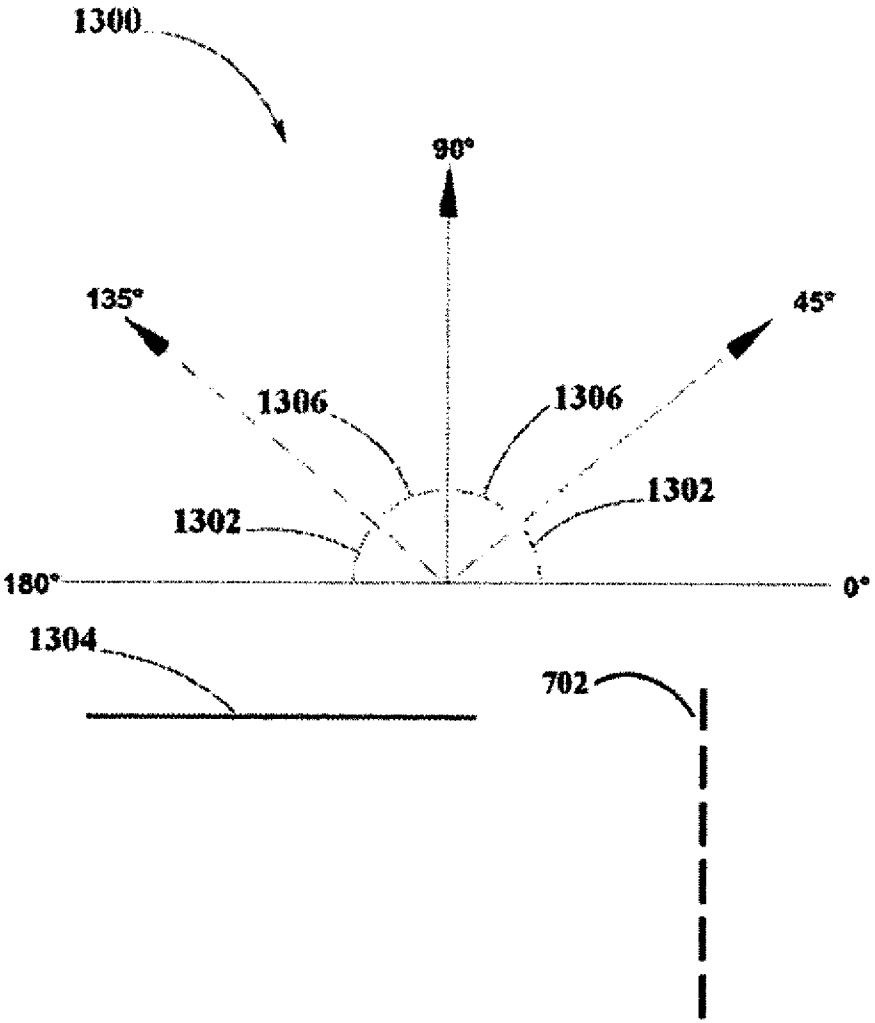
FIG. 13 illustrates a plurality of orientation ranges for flexo-master patterns according to embodiments of the present disclosure.

FIG. 13 illustrates a plurality of orientation ranges for flexo-master patterns according to embodiments of the present invention. FIG. 13 shows pattern styles 1300 for the lines 206 according to the orientation angle of printed lines on flexo-master 110. A CAD file is generated with a specific pattern, then this CAD file is converted into a bitmap file that will be turned into a patterned flexo-master 110. The drawing of the pattern has to be made according to transverse direction 304 or machine direction 302 (see FIG. 5). If the drawing from the CAD file is for a transverse direction pattern, continuous lines 1304 are preferred as they allow an improved control over printing factors such as printing speed, ink viscosity, pressure and volume of ink 120. If the drawing from the CAD file is for a machine direction pattern, non-continuous lines 702 are preferred. It is appreciated that printing results may vary based on the ink viscosity, surface energy of the substrate (both natural and changes induced through Corona discharge), temperature of the components, as well as the size/volume of the anilox roll used. In one example, anilox rolls 106 with a volume of less than 1 BCM (Billion Cubic Microns per square inch) may have a dot gain that is small enough to not significantly alter dimensions of printed features because as the volume of ink transferred from the anilox roll to the flexo-plate decreases, there is less ink present to contribute to malformation or incomplete formation of features. However, if the dimensions of the printed pattern are small enough, even ink transfer from an anilox roll 106 of 1 BCM or less may present a concern and an opportunity to use non-continuous lines. In most cases, however, the non-continuous lines 702 on a flexo-master 110 used to print continuous lines and features can be used for larger line widths.

Furthermore, the orientation printing angles may have certain characteristics that may limit the angles thereof. That is, orientation printing angles ranging between 0° to 45° and between 135° to 180° may be considered transverse angles 1302 as they are closer to transverse direction 304 (0° and 180° degrees), thus continuous lines 1304 are preferred. Conversely, orientation printing angles ranging between 45° to 135° degrees are considered machine angles 1306 as they are closer to machine direction 302 (90° degrees), then non-continuous lines 702 can be used. As such, while the transverse direction 304 is illustrated as being generally at or near perpendicular to the machine direction 302 in the figures above, and the term "transverse direction" 304 as used herein is used to define a direction that is not the same as the machine direction 302 but rather intersects the machine direction 302. It is appreciated that, while the machine direction 302 and the transverse direction 304 are illustrated in various figures discussed above, the directions indicated in those figures are merely illustrative and that the determination of the range angles of lines in both directions may include considerations such as ink viscosity, machine pressure, and pattern design as well as other factors such as machine speed. In an embodiment, the printing plate cylinder rotates in a first direction, and a portion of the plurality of lines are oriented within a first predetermined range of the first direction. In this embodiment, a portion of the plurality of lines are oriented at an angle outside of the first predetermined range of the first direction, wherein the plurality of lines within the first predetermined range are non-continuous lines 702; and the plurality of lines outside of the first predetermined range are continuous lines 1304.

Figure 14:
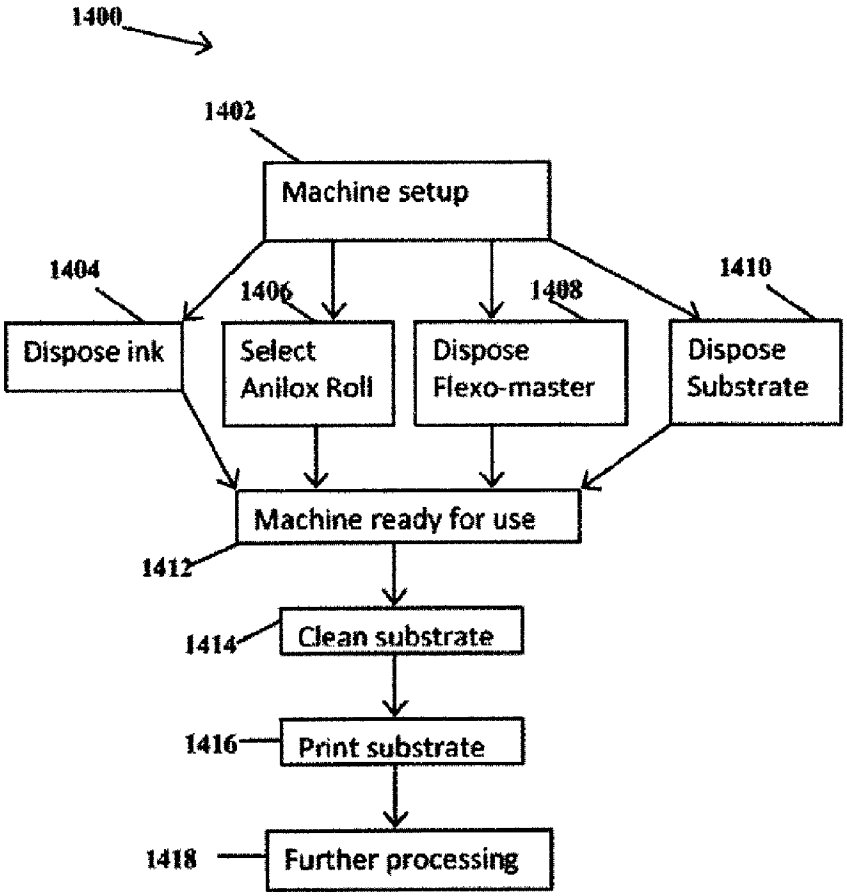
FIG. 14 is a flow chart of a method of flexographic printing according to embodiments of the present disclosure.

FIG. 14 is a flow chart of a method of flexographic printing according to embodiments of the present disclosure. In method 1400, the flexo-graphic printing system, for example, flexographic printing system 100 (FIG. 1) as discussed in FIG. 1, is set up at block 1402. The machine setup at block 1402 may include disposing ink at block 1404 into an ink pan 102 (FIG. 1) or other ink source, selecting at least one anilox roll 106 (FIG. 1) at block 1406, disposing a flexo-master 110 (FIG. 1) onto a printing plate cylinder 108 (FIG. 1) at block 1408, and disposing the substrate (FIG. 1) 116 into the flexographic printing system 100. The substrate 116 may be a printable substance such as polyethylene terephthalate (PET), High-density polyethylene (HOPE), linear low-density polyethylene (LLDPE), biaxially-oriented polypropylene (BOPP), polyester, polypropylene, foam sheets, paper, aluminum foil, other metallic foil, or thin glass.

In some embodiments, more than one ink type may be used, so there may be more than one ink source. In some embodiments, a plurality of anilox rolls 106 and printing plate cylinders 108 may be used in the method 1400. In those embodiments, each of the plurality of printing plate cylinders 108 may each have a flexo-master 110 disposed on it at block 1408, where each flexo-master 110 comprises a different portion of a single pattern. These different portions may comprise varying line widths, transitional geometries, and may use the same ink or different types of ink. At block 1412 the flexographic printing system 100 is ready for use, the substrate 116 disposed into the flexographic printing system 100 at block 1410 may be cleaned at block 1414 using a water wash, web cleaner, or other cleaning method. At block 1416, the substrate 116 is printed using the at least one flexo-master 110 disposed on the at least one printing plate cylinder 108 at block 1408. In some embodiments, the substrate 116 as discussed above may be printed on a single side and in some embodiments the substrate 116 may be printed on both sides. The double-sided printing may be accomplished by using a single flexo-master 110 disposed on a single printing plate cylinder 108, or by a plurality of flexo-masters 110 using a plurality of printing plate cylinders 108, and each side may be printed in the same manner or in a different manner, using the same ink or a plurality of inks as appropriate for the application. As discussed above, at least in part to leverage inherent properties of ink due to its viscosity, composition, temperature sensitivity, pressure sensitivity as well as other system factors, the at least one flexo-master 110 used to print the pattern may include at least one non-continuous line, a junction shape smaller than the printed junction shape, a single line that prints two lines, or at least two lines that are used to print a single line. At block 1418, the printed substrate from block 1416 may be further processed. It is appreciated that the further processing may include curing, plating, electroless plating, coating, trimming, cutting, packaging, and/or further assembly.

Figure 15:
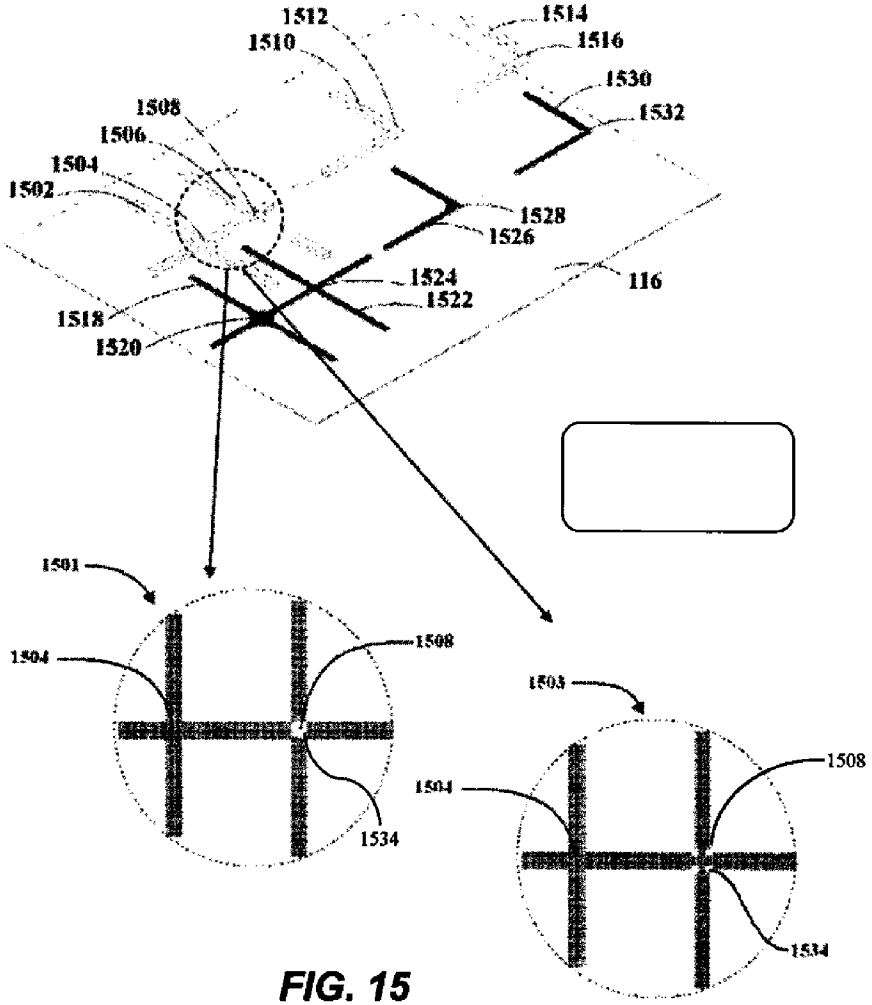
FIG. 15 is an illustration of a plurality of flexo-master pattern feature and resulting printed pattern features.

FIG. 15 is an illustration of a plurality of flexo-master pattern features and resulting printed pattern features. FIG. 15 shows the printed results on the substrate 116 from four patterns on the flexo-master 110 (not shown). The patterns on the flexo-master 110 are depicted above the printed results on substrate 116. The printed patterns are: (1) a first flexo-master junction 1502 having a solid intersection 1504, (2) a second flexo-master junction 1506 having a hollowed-out intersection 1508 as compared to solid intersection 1504 (see exploded view 1501), (3) a first flexo-master angle pattern 1510 with a solid corner 1512, and (4) a second flexo-master angle pattern 1514 with a hollowed-out corner 1516 as compared to the solid corner 1512 which may also be referred to as a fillet. It is appreciated that the term "corner," as used herein, may be used to describe an angle of any degree formed by one or more lines.

It is appreciated that, while two intersecting lines and a corner are illustrated in FIG. 15, more than two lines may form a junction, depending upon the embodiment, and that the flexo-master pattern portions shown in FIG. 15 are for illustrative purposes to compare to the printed patterns and are not actually located on the substrate 116. A hollowed-out intersection 1508 on the flexo-master is best described as compared to a solid intersection 1504 in that the solid intersection 1504 may be where two or more lines intersect at any angle and the dimensions of each intersecting line are preserved in the dimensions of the solid intersection 1504. It is appreciated that the exploded view 1501 of solid intersection 1504 and hollowed-out intersection 1508 is shaded for illustrative purposes to clarify, the hollowed-out intersection 1508 is where the dimensions of each intersecting line are not preserved and instead a portion of the line is carved out to create a hollow 1534 which may also be described as a hollow void. It is appreciated that the flexo-master may be manufactured with this feature, and that the term "carved-out" refers to the flexo-master feature as compared to the printed feature. It is also appreciated that a flexo-master 110 may be manufactured as discussed above and then further processed to thermally and/or mechanically alter feature size in order to print a corresponding feature within certain dimensional ranges.

Exploded view 1503 shows an alternate configuration for the hollowed-out intersection 1508. It is appreciated that the exploded view 1503 of solid intersection 1504 and hollowed-out intersection 1508 is shaded for illustrative purposes to clarify the form of the hollowed-out intersection 1508 which includes four hollows 1534 in this example.

While FIG. 15 shows the intersection of two lines at a hollowed out intersection 1508 with one or four hollows 1534, it will be appreciated that more than two lines may intersect, and the intersection may comprise one or more hollows 1534 depending upon factors such as ink viscosity, machine speed, pressure, and pattern dimensions. In some embodiments, if there is more than one hollow 1534, the hollows 1534 may be of uniform size, and in other embodiments the hollows 1534 may be of differing dimensions. An intersection of two or more lines may be referred to as a junction or as an intersection, or as a collection of fillets or hollows 1534.

Printing the first flexo-master junction 1502 having a solid intersection 1504 results in first printed crossing line pattern 1518 having a large/over-filled printed intersection 1520 at the intersection of the crossing lines. The term "over-filled" is used to reflect that the printed feature did not print to the dimensions specified for a particular feature, features and/or overall pattern. Printing the second flexo-master junction 1506 with a hollowed-out intersection 1508 results in the second printed crossing line pattern 1522 having a small (as compared to the larger printed intersection 1520 discussed earlier) printed intersection 1524 at the intersection of the crossing lines. In an embodiment, the small printed intersection 1524 is printed to a plurality of predetermined dimensions that may be associated with a particular application. Therefore, while it may be referred to as a "small" printed intersection 1524, the dimensions printed are merely small as compared to the large printed intersection 1520 which was printed without the hollows 1534 of the hollowed-out intersection 1508. This difference can also be explained by observing that, in the preferred embodiment, the shape/geometry of the hollowed-out intersection 1508 at or near the point of intersection is different than the corresponding location on the smaller printed intersection 1524.

Printing the first flexo-master angle pattern 1510 having the solid corner 1512 results in first printed angle pattern 1526 having a large/over-filled printed corner 1528 at the corner of the angled lines. Printing the second flexo-master angle pattern 1514 having the hollowed-out corner 1516 results in a second printed angle pattern 1530 having a small printed corner 1532 at the corner of the angled lines. Therefore, in an embodiment, if there is a desire to control the movement of the ink with respect to a printed junction or intersection of two or more lines, a hollowed-out intersection 1508 may be used on the flexo-master 110 where the dimensions of the hollowed-out intersection 1508 are smaller than the dimensions of the desired printed intersection 1524. The geometry of the hollowed-out intersection 1508 is thereby used to affect the printed pattern. In another embodiment, it is understood that this modified hollowed-out intersection 1508 does not print its geometry on the substrate 116 but rather is designed with properties such as ink viscosity, flexo-master material, pressures, and other factors to print a portion of a pattern within a predefined tolerance range of at least height, width, and length. It may be said that the junction/corner/intersection embodiment in FIG. 15 is one wherein the shape of a flexo-master feature is different than the shape of the corresponding printed feature to minimize the occurrence of large/over-filled printed corners 1528 and printed intersections 1520.

In an embodiment, a high precision flexo-master 110 for making printed electronic patterns is comprised of raised printing surfaces where the ink is transferred from the flexo-master 110 to the substrate 116, leaving a printed pattern on the substrate 116. The flexo-master 110 preferably includes a non-continuous pattern to form straight lines that are printed in the machine direction 302 as discussed with reference to FIG. 7. In yet another embodiment, a high precision flexo-master 110 for making printed electronic patterns has patterned lines in a transverse direction 304 where the lines are continuous patterns. The desired width of line is achieved by optimizing the printing factors such as target speed, viscosity, pressure and volume of ink. In a related embodiment, a single line may be used to print two lines as discussed with reference to FIG. 4(*c*), or multiple lines on the flexo-master 110 may be used to print a single line, leveraging the otherwise undesirable phenomena as discussed with reference to FIG. 6. It is appreciated that the systems and methods disclosed herein may utilize any combination of the flexo-master features described above in order to reliably print uniform patterns.

Certain terms are used throughout the following descriptions and claims to refer to particular system components. This document does not intend to distinguish between components that differ in name but not function. In the following discussion and in the claims, the terms "including" and "comprising" are used in an open-ended fashion, and thus should be interpreted to mean "including, but not limited to . . . " As used herein, the word "approximately" is intended to mean "plus or minus 10%."

It is appreciated that the embodiments described herein with respect to the junctions, a single flexo-master line printing two lines, multiple flexo-lines printing one line, and non-continuous lines as well as flexo-masters of varying thickness may be used in various combinations to produce microscopic printed patterns. The methods and systems disclosed herein may use various combinations of these embodiments along with multiple types of ink 120 in a single flexographic printing system 100, and in some cases multiple printing plate cylinders 108 may be used to print a single pattern, where each printing plate cylinder 108 has a portion of the pattern in a flexo-master 110 disposed on the printing place cylinder 108.

The invention has been described with reference to a preferred embodiment. However, it will be appreciated that variations and modifications can be effected by a person of ordinary skill in the art without departing from the scope of the invention.

PARTS LIST

100 flexographic printing system
102 ink pan
104 fountain roll
106 anilox roll
108 printing plate cylinder
110 flexo-master
112 impression cylinder
114 doctor blade
116 substrate
118 contact printing area
120 ink
122 ink transfer area
202 raised printing surface
204 sidewall
206 line
206*a* line
206*b* line
302 machine direction
304 transverse direction
402 cell
404 excess ink
406 insufficient ink

502 irregular shape
504 cross pattern
506 crossover point
508 appendage
510 line
512 printed line
514 non-continuous printed line
602 printed line
604 line
702 non-continuous line
704 gap spacing
706 printed line
902 printed lines
1000 flexographic printing system
1002 swelling
1004 tall patterned line
1006 short patterned line
1008 tall feature arc
1010 short feature arc
1100 pattern design
1102 transitional area
1104 small patterned lines
1106 large patterned lines
1108 break
1110 necking
1112 fill pattern
1114 fill pattern
1116 fill pattern
1118 fill pattern
1202 line
1204 line
1300 pattern styles
1302 transverse angles
1304 continuous line
1306 machine angles
1400 flexographic printing method
1402 machine setup block
1404 dispose ink block
1406 select anilox roll block
1408 dispose flexo-master block
1410 dispose substrate block
1412 ready for use block
1414 clean substrate block
1416 print substrate block
1418 further processing block
1501 exploded view
1502 first flexo-master junction
1503 exploded view
1504 solid intersection
1506 second flexo-master junction
1508 hollowed-out intersection
1510 flexo-master angle pattern
1512 solid corner
1514 flexo-master angle pattern
1516 hollowed-out corner
1518 printed crossing line pattern
1520 printed intersection
1522 printed crossing line pattern
1524 printed intersection
1526 printed angle pattern
1528 printed corner
1530 printed angle pattern
1532 printed corner
1534 hollow
T1 section
T2 section

The invention claimed is:

1. A method of flexographically printing a plurality of lines onto a substrate, comprising:

providing a flexo-master having a pattern of raised features including a plurality of lines, wherein the lines extend in a length direction and include one or more line segments, each line segment having a uniform line width along a length of the line segment, wherein at least two of the lines intersect at a junction, and wherein the junction includes one or more hollow voids;

using the flexo-master to apply ink onto the substrate forming a printed pattern including printed lines corresponding to the lines on the flexo-master that intersect at a printed junction corresponding to the junction on the flexo-master, wherein the printed junction has a different shape than the junction on the flexo-master and does not include hollow voids.

2. The method of claim 1, further including transferring ink from an ink source to an anilox roll, and transferring ink from the anilox roll to the flexo-master.

3. The method of claim 1, wherein the plurality of lines on the flexo-master pattern includes a non-continuous line including a plurality of line segments, and wherein the printed pattern includes a continuous line corresponding to the non-continuous line on the flexo-master.

4. A system for flexographically printing a substrate, comprising:

a printing plate cylinder, wherein an anilox roll transfers ink to a flexo-master disposed on the printing plate cylinder, the flexo-master having a pattern of raised printing surfaces including a plurality of lines, each line extending in a length direction, wherein one or more of the plurality of lines are non-continuous lines including a plurality of line segments separated by gaps, each line segment having a uniform line width along a length of the line segment; and a substrate, wherein ink is transferred from the flexo-master to the substrate forming a printed pattern, and wherein the non-continuous lines on the flexo-master form corresponding continuous lines in the printed pattern;

wherein the printing plate cylinder rotates in a first direction, wherein a first portion of the plurality of lines on the flexo-master are oriented within a first predetermined angular range of the first direction, and wherein a second portion of the plurality of lines on the flexo-master are oriented at an angle outside of the first predetermined angular range of the first direction;

wherein the first portion of the plurality of lines are non-continuous lilies, and wherein the second portion of the plurality of lines are continuous lines;

wherein printed lines in the printed pattern corresponding to the first portion of the plurality of lines are continuous printed lines.

5. The system of claim 4, wherein the plurality of line segments of at least one of the non-continuous lines are uniform, having the same height, line width and length.

6. The system of claim 4, wherein at least one of the non-continuous lines includes at least two non-uniform line segments which differ in height, line width or length.

7. The system of claim 4, wherein a first line of the plurality of lines is parallel to a second line of the plurality of lines, and wherein the first and second lines form a single printed line in the printed pattern.

8. The system of claim 4, wherein at least two of the plurality of lines on the flexo-master intersect at a junction, the junction including one or more hollow voids, wherein the printed pattern includes a printed junction corresponding to the junction on the flexo-master, and wherein the printed junction does not include hollow voids.

* * * * *